US010704169B2

(12) United States Patent
Habicht et al.

(10) Patent No.: US 10,704,169 B2
(45) Date of Patent: Jul. 7, 2020

(54) FLAME RESISTANT FABRICS HAVING CELLULOSIC FILAMENT YARNS

(71) Applicant: Southern Mills, Inc., Union City, GA (US)

(72) Inventors: Christine J. Habicht, Peachtree City, GA (US); Charles S. Dunn, Griffin, GA (US); Michael T. Stanhope, Atlanta, GA (US); Matthew Lucius Colatruglio, Roswell, GA (US)

(73) Assignee: Southern Mills, Inc., Union City, GA (US)

( * ) Notice: Subject to any disclaimer, the term of this patent is extended or adjusted under 35 U.S.C. 154(b) by 0 days.

(21) Appl. No.: 15/327,069

(22) PCT Filed: Aug. 31, 2015

(86) PCT No.: PCT/US2015/047762

§ 371 (c)(1),
(2) Date: Jan. 18, 2017

(87) PCT Pub. No.: WO2016/033593

PCT Pub. Date: Mar. 3, 2016

(65) Prior Publication Data

US 2017/0175302 A1 Jun. 22, 2017

Related U.S. Application Data

(60) Provisional application No. 62/043,737, filed on Aug. 29, 2014, provisional application No. 62/154,248, filed on Apr. 29, 2015.

(51) Int. Cl.

| | |
|---|---|
| ***D02G 3/44*** | (2006.01) |
| ***A41D 31/00*** | (2019.01) |
| ***D03D 15/12*** | (2006.01) |
| ***D04B 1/16*** | (2006.01) |
| ***D03D 1/00*** | (2006.01) |
| ***D02G 3/02*** | (2006.01) |
| ***A41D 31/08*** | (2019.01) |

(52) U.S. Cl.

CPC ..... *D02G 3/443* (2013.01); *A41D 31/08* (2019.02); *D02G 3/02* (2013.01); *D03D 1/0035* (2013.01); *D03D 15/12* (2013.01); *D04B 1/16* (2013.01); *D10B 2201/20* (2013.01); *D10B 2321/101* (2013.01); *D10B 2331/021* (2013.01)

(58) Field of Classification Search

None

See application file for complete search history.

(56) References Cited

U.S. PATENT DOCUMENTS

| | | | | |
|---|---|---|---|---|
| 8,819,866 | B2 | 9/2014 | Underwood et al. | |
| 2004/0152378 | A1* | 8/2004 | Stanhope | B32B 5/26 442/5 |
| 2007/0184737 | A1 | 8/2007 | Corner et al. | |
| 2008/0038973 | A1* | 2/2008 | Sasser | D03D 15/12 442/181 |
| 2008/0057807 | A1* | 3/2008 | Tutterow | A41D 31/0022 442/1 |
| 2010/0029790 | A1 | 2/2010 | Lombardo | |
| 2010/0112312 | A1 | 5/2010 | Tutterow | |
| 2010/0297905 | A1 | 11/2010 | Ulrich et al. | |
| 2012/0017191 | A1 | 1/2012 | Chen et al. | |
| 2012/0171918 | A1* | 7/2012 | Lawson, III | D03D 15/0033 442/302 |
| 2013/0006547 | A1 | 1/2013 | Akada | |
| 2013/0065470 | A1* | 3/2013 | Rock | B32B 5/26 442/302 |
| 2014/0026303 | A1 | 1/2014 | Zhu | |
| 2014/0208491 | A1* | 7/2014 | Schmitt | A41D 31/08 2/458 |

FOREIGN PATENT DOCUMENTS

| | | |
|---|---|---|
| CN | 1320179 | 10/2001 |
| CN | 102985604 | 3/2013 |
| CN | 103622186 A | 3/2014 |
| CN | 103906869 | 7/2014 |
| DE | 202013101921 | 5/2013 |
| JP | 2008025035 | 2/2008 |
| JP | 2010-502849 A | 1/2010 |
| WO | 2010135214 | 11/2010 |
| WO | 2014018221 | 1/2014 |

OTHER PUBLICATIONS

International Preliminary Report on Patentability, PCT Application No. PCT/US2015/047762, dated Mar. 9, 2017.

International Search Report and Written Opinion, PCT Application No. PCT/US2015/047762, dated Jan. 12, 2016.

Chinese Office Action, Chinese Patent Application No. 201580046545.9, dated Jan. 29, 2018.

Extended European Search Report, European Patent Application No. 15835694.9, dated Apr. 19, 2018, 6 pages.

Office Action, Chinese Patent Application No. 201580046545.9, dated Dec. 3, 2018, 23 pages.

Office Action, Chinese Patent Application No. 201580046545.9, dated Jun. 19, 2019, 19 pages.

Office Action, Japanese Patent Application No. 2017-511319, dated Aug. 13, 2019, 7 pages.

Office Action, Australian Patent Application No. 2015308591, First Examination Report, dated Jan. 15, 2020, 3 pages.

Office Action, Brazilian Patent Application No. 1120170025051, dated Dec. 17, 2019, 7 pages.

* cited by examiner

*Primary Examiner* — Shawn Mckinnon

(74) *Attorney, Agent, or Firm* — Kilpatrick Townsend & Stockton LLP

(57) ABSTRACT

Flame resistant fabrics that have incorporated into them cellulosic filament yarns. The cellulosic filament yarns may be flame resistant (either inherently FR or treated so as to be FR) or non-flame resistant. Fabrics according to some embodiments are formed entirely of cellulosic filament yarns. However, fabrics according to some embodiments include additional yarns to ensure that the fabric complies with NFPA 1971 and/or 2112.

31 Claims, No Drawings

FLAME RESISTANT FABRICS HAVING CELLULOSIC FILAMENT YARNS

CROSS-REFERENCE TO RELATED APPLICATIONS

This application is a U.S. national phase application under 35 U.S.C. § 371 of International Patent Application No. PCT/US2015/047762, titled "Flame Resistant Fabrics Having Cellulosic Filament Yarns" and filed Aug. 31, 2015, which claims the benefit of U.S. Provisional Application Ser. No. 62/043,737, filed on Aug. 29, 2014, entitled "Face Cloths for Fire Fighter Thermal Liners Having Cellulosic Filament Yarns," and U.S. Provisional Application Ser. No. 62/154,248, filed on Apr. 29, 2015, entitled "Facecloths for Fire Fighter Thermal Liners Having Cellulosic Filament and/or Stretch Broken Yarns," the entirety of all of which are hereby incorporated by this reference.

FIELD

Embodiments of the present invention relate to flame resistant fabrics formed at least in part with cellulosic filament yarns.

BACKGROUND

Protective garments are designed to protect the wearer from hazardous environmental conditions the wearer might encounter. Such garments include those designed to be worn by firefighters and other rescue personnel, industrial and electrical workers, and military personnel.

Standards have been promulgated that govern the performance of such garments (or constituent layers or parts of such garments) to ensure that the garments sufficiently protect the wearer in hazardous situations. For example, National Fire Protection Association (NFPA) 1971 (2013 edition, incorporated herein by this reference) governs the required performance of firefighter garments. NFPA 2112 (2012 edition, incorporated herein by this reference) governs the required performance of industrial worker garments that protect against flash fires. Both of these standards require that the garments and/or individual layers or parts thereof pass a number of different performance tests, including compliance with the thermal protective requirements of having a 4 inch (or less) char length and a 2 second (or less) afterflame when measured pursuant the testing methodology set forth in ASTM D6413 (1999), the entirety of which is hereby incorporated by reference.

To test for char length and afterflame, a fabric specimen is suspended vertically over a flame for twelve seconds. The fabric must self-extinguish within two seconds (i.e., it must have a 2 second or less afterflame). After the fabric self-extinguishes, a specified amount of weight is attached to the fabric and the fabric lifted so that the weight is suspended from the fabric. The fabric will typically tear along the charred portion of the fabric. The length of the tear (i.e., the char length) must be 4 inches or less when the test is performed in both the machine/warp and cross-machine/weft directions of the fabric. A fabric sample is typically tested for compliance both before it has been washed (and thus when the fabric still contains residual—and often flammable—chemicals from finishing processes) and after a certain number of launderings (100 launderings for NFPA 2112 and 5 launderings for NFPA 1971).

NFPA 1971 and NFPA 2112 also contain requirements relating to the extent to which the fabric shrinks when subjected to heat. The thermal shrinkage of the fabric is measured pursuant to the methodology set forth in ISO 17493 (2000, the entirety of which is herein incorporated by reference). To conduct thermal shrinkage testing, marks are made on the fabric a distance from each other in both the machine/warp and cross-machine/weft directions. The distance between sets of marks is noted. The fabric is then suspended in a 500 degree oven for 5 minutes. The distance between sets of marks is then re-measured. The thermal shrinkage of the fabric is then calculated as the percentage that the fabric shrinks in both the machine/warp and cross-machine/weft directions and must be less than the percentage set forth in the applicable standard. For example, NFPA 1971 requires that the fabrics used in the construction of a firefighter's garment exhibit thermal shrinkage of less than <10% in both the machine/warp and cross-machine/weft directions.

Structural fire fighters garments, such as firefighters' turnout gear, typically consist of matching coat and pants and are designed primarily to prevent the wearer from sustaining a serious burn. NFPA compliant turnout gear or garments are typically comprised of three layers: an outer shell, an intermediate moisture barrier, and a thermal barrier lining. The outer shell is usually a woven fabric made from flame resistant fibers and is considered a firefighter's first line of defense. Not only should it resist flame, but it needs to be tough and durable so as not to be torn, abraded, or snagged during normal firefighting activities.

The moisture barrier, while also flame resistant, is present to keep water and harmful chemicals from penetrating and saturating the turnout gear. Excess moisture entering the gear from the outside would laden the firefighter with extra weight and increase his or her load.

The thermal barrier is flame resistant and offers the bulk of the thermal protection afforded by the ensemble. A traditional thermal barrier is a batting made of a nonwoven fabric of flame resistant fibers quilted to a lightweight woven facecloth also made of flame resistant fibers. The batting may be either a single layer of needle-punch nonwoven fabric or multiple layers of spun lace nonwoven fabric. The facecloth is commonly quilted to the batting in a cross-over or chicken wire pattern. The quilted thermal barrier is the innermost layer of the firefighter's garment, with the facecloth typically facing the wearer.

The facecloth fabrics of thermal liners protect the batt from abrasion and are in direct contact with either the firefighters' station wear or skin. Facecloths woven with filament yarns are slicker than facecloths woven with 100% spun yarns. This slickness is desirable for easier donning and doffing of the structural firefighting garment as well as ease of movement when the garment is worn.

There are limited inherently flame resistant filament yarns commercially available which can be used to weave the facecloth fabric and still meet the thermal protective and thermal shrinkage requirements discussed above. The filament yarns used in existing facecloths are made with some version of filament aramid yarn woven with 100% aramid spun yarns, spun yarns with some blend of flame resistant ("FR") rayon, aramid and nylon, or a combination thereof. These fabrics are expensive, may have a harsh hand "or feel," do not easily wick sweat away from the skin to relieve heat stress, and are hydrophobic so as to exhibit low moisture regain. The aramid filament yarns used in these fabrics can also be difficult to dye and/or print. There is a need for fabrics (such as, but not limited to, facecloth fabrics) formed with lower cost filament yarns that—whether alone or when attached to another layer (such as a batt)—meet the performance requirements of NFPA 1971 while being inherently wicking, soft, and easily dyeable.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention relate to flame resistant fabrics that have incorporated into them cellulosic filament yarns.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention include a flame resistant fabric (which may be, but does not have to be, a facecloth fabric for use in a thermal liner in a firefighter's garment) woven or knitted from a combination of yarns of which at least some are slick, soft, easily dyeable, inherently wicking, and hydrophilic. Embodiments of the present invention incorporate into the fabric filament yarns, which have good slickness and inherent wicking and that are soft and easily dyeable. In some embodiments, cellulosic filament yarns are used. While cellulosic filament yarns are specifically discussed herein, it should be understood that cellulosic stretch broken yarns could replace the cellulosic filament yarns in any of the embodiments contemplated herein. The cellulosic filament yarns may be made up of, but not limited to, acetate, tri-acetate, filament rayon, filament lyocell, and other cellulosics. The cellulosic filament yarns may be flame resistant (either inherently FR or treated so as to be FR) or non-flame resistant, and inventive fabrics may include a combination of both.

Fabrics according to some embodiments are formed entirely of cellulosic filament yarns. Different types of cellulosic filament yarns may be used in such fabrics or the same type of cellulosic filament yarns may be used throughout the fabric. By way only of example, in some embodiments, the cellulosic filament yarns used in the fabric are identical and are provided every pick and every end. For example, FR rayon filament yarns might be suitable in such embodiments. However, it may be necessary to include additional yarns in the fabric to ensure that the fabric complies with the relevant requirements, such as those of NFPA 1971 and/or 2112.

Non-FR cellulosic filament yarns themselves do not impart the necessary flame resistance to the fabric. Thus, it may be necessary to include flame resistant fibers in fabrics formed with non-FR cellulosic filament yarns. For example, flame resistant filament, spun, or stretch broken yarns (collectively referred to as "FR Yarns") may be woven or knitted with the non-FR cellulosic filament yarns. The FR Yarns can be any type or blend of yarn and provided in any amount in the fabric so as to ensure compliance of the fabric with the relevant thermal protection standards of NFPA 1971 and/or NFPA 2112.

Exemplary suitable FR and non-FR materials (in either fiber or filament form, as available and desired) that can be used to form the FR Yarns include, but are not limited to, para-aramid, meta-aramid, polybenzoxazole (PBO), polybenzimidazole (PBI), modacrylic, poly {2,6-diimidazo[4,5-b:40; 50-e]-pyridinylene-1,4(2,5-dihydroxy)phenylene} (PIPD), ultra-high molecular weight (UHMW) polyethylene, UHMW polypropylene, polyvinyl alcohol, polyacrylonitrile (PAN), liquid crystal polymer, glass, nylon (and FR nylon), polynosic rayon, carbon, silk, polyamide, polyester, aromatic polyester, natural and synthetic cellulosics (e.g., cotton, rayon, acetate, triacetate, and lyocell, as well as their flame resistant counterparts FR cotton, FR rayon, FR acetate, FR triacetate, and FR lyocell), TANLON™ (available from Shanghai Tanlon Fiber Company), wool, melamine (such as BASOFIL™ available from Basofil Fibers), polyetherimide, polyethersulfone, pre-oxidized acrylic fibers, polyamide-imide fibers such as KERMEL™, polytetrafluoroethylene, polyvinyl chloride, polyetheretherketone, polyetherimide, polychlal, polyimide, polyamide, polyimideamide, polyolefin, nylon and any combination or blend thereof.

An example of suitable modacrylic fibers are PROTEX™ fibers available from Kaneka Corporation of Osaka, Japan, SEF™ available from Solutia, or blends thereof. Examples of suitable rayon materials are Viscose™ and Modal™ by Lenzing, available from Lenzing Fibers Corporation. An example of an FR rayon material is Lenzing FR™, also available from Lenzing Fibers Corporation, and VISIL™, available from Sateri. Examples of lyocell material include TENCEL™, TENCEL G100™ and TENCEL A100™, all available from Lenzing Fibers Corporation. Examples of para-aramid fibers include KEVLAR™ (available from DuPont), TECHNORA™ (available from Teijin Twaron BV of Arnheim, Netherlands), and TWARON™ (also available from Teijin Twaron BV). Examples of meta-aramid fibers include NOMEX™ (available from DuPont), CONEX™ (available from Teijin), and APYEIL™ (available from Unitika). An example of a polyester fiber is DACRON® (available from Invista™). An example of a PIPD fiber includes M5 (available from Dupont). An example of melamine fibers is BASOFIL™ (available from Basofil Fibers). An example of PAN fibers is Panox® (available from the SGL Group). Examples of UHMW polyethylene materials include Dyneema and Spectra. An example of a liquid crystal polymer material is VECTRAN™ (available from Kuraray).

In some embodiments, the FR Yarns are spun yarns that include modacrylic fibers that help impart the necessary flame resistance to the fabric. In some embodiments, the amount of modacrylic fibers in the FR Yarn is controlled to keep the non-FR cellulosic filament yarns and any other non-FR fibers in the spun yarn from having an after-flame greater than 2 seconds. While the FR Yarns may comprise 100% modacrylic fibers, in other embodiments they are blended with only one additional fiber type or with two or more additional fiber types. The modacrylic fibers may be blended with any of the FR and non-FR fibers identified above. The particular fiber blends of yarns disclosed in U.S. patent application Ser. No. 11/847,993, entitled "Flame Resistant Fabrics and Garments Made From Same" and published as US-2008-0057807-A1, the entire contents of which is herein incorporated by reference, are contemplated herein for the FR Yarns, although other blends are certainly within the scope of this disclosure.

In one embodiment, at least some of the FR Yarns used in the fabric are formed from a fiber blend having approximately 30-90% FR modacrylic fibers. Additional fibers in such blends could include either or both of approximately 10-70% cellulosic fibers (e.g., cotton, rayon, acetate, triacetate, and lyocell, as well as their flame resistant counterparts FR cotton, FR rayon, FR acetate, FR triacetate, and FR lyocell) and of approximately 5-70% additional inherently FR fibers (e.g., para-aramid, meta-aramid, PBO, PBI, etc.). In a more specific non-limiting example, at least some of the FR Yarns used in the fabric are formed from a fiber blend having approximately 30-70% FR modacrylic fibers and either or both of approximately 30-70% cellulosic fibers and of approximately 5-50% additional inherently FR fibers. In a more specific non-limiting example, at least some of the FR Yarns used in the fabric are formed from a fiber blend having approximately 30-70% FR modacrylic fibers and either or both of approximately 30-50% cellulosic fibers and of approximately 5-25% additional inherently FR fibers. In a much more specific example that is certainly not intended to limit the scope of the invention discussed herein, the FR Yarns include a blend of between approximately 40-70% FR modacrylic fibers, approximately 30-40% cellulosic fibers (such as, but not limited to, synthetic cellulosic fibers such as TENCEL™ fibers and TENCEL A100™ fibers), and approximately 10-15% aramid fibers (such as, but not limited to, para-aramid fibers).

Specific examples of embodiments of FR Yarns that could be included in embodiments of the fabric are described below.

FR Yarn #1: Spun yarn having a blend of approximately 50% FR modacrylic (PROTEX C™), approximately 40% cellulosic (TENCEL A100™), and approximately 10% para-aramid (TWARON™).

FR Yarn #2: Spun yarn having a blend of approximately 45% FR modacrylic (PROTEX C™), approximately 35% of a first cellulosic (TENCEL A100™), approximately 10% of a second cellulosic (Lenzing FR™ or FR rayon), and 10% para-aramid (TWARON™).

FR Yarn #3: Spun yarn having a blend of approximately 50% FR modacrylic (PROTEX C™), approximately 35% cellulosic (TENCEL A100™), approximately 10% nylon, and approximately 5% para-aramid (TWARON™).

FR Yarn #4: Spun yarn having a blend of approximately 48% FR modacrylic (PROTEX C™), approximately 37% cellulosic (TENCEL A100™), and approximately 15% para-aramid (TWARON™).

FR Yarn #5: Spun yarn having a blend of approximately 50% FR modacrylic (PROTEX C™), approximately 39% cellulosic (TENCEL A100™), approximately 10% para-aramid (TWARON™), and approximately 1% antistat.

Other FR Yarns used in embodiments of the fabric may not include modacrylic fibers. For example, other embodiments of the FR Yarns are spun yarns formed of at least one of 0-100% cellulosic fibers (e.g., cotton, rayon, acetate, triacetate, and lyocell, as well as their flame resistant counterparts FR cotton, FR rayon, FR acetate, FR triacetate, and FR lyocell), 0-100% inherently FR fibers (e.g., meta-aramid or para-aramid, PBI, PBO, glass, carbon, liquid crystal polymer material, mineral-based materials, melamine, and other similar materials exhibiting low thermal shrinkage), and 0-20% nylon, as well as blends of any or all of these fibers. More specifically, other embodiments of FR Yarns are spun yarns formed of 0-80% cellulosic fibers, 10-80% inherently FR fibers, and 0-20% nylon, as well as blends of any or all of these fibers. Even more specifically, other embodiments of FR Yarns are spun yarns formed of 20-80% cellulosic fibers, 10-60% inherently FR fibers, and 0-20% nylon, as well as blends of any or all of these fibers. Even more specifically, other embodiments of FR Yarns are spun yarns formed of 50-80% cellulosic fibers, 10-40% inherently FR fibers, and 0-15% nylon, as well as blends of any or all of these fibers. One specific embodiment of an FR Yarn (FR Yarn #6) is a spun yarn formed of approximately 65% FR cellulosic (such as FR rayon), 25% para-aramid, and 10% nylon.

In some embodiments, the non-FR cellulosic filament yarns are provided in only one of the machine/warp or cross-machine/weft direction (the "cellulosic filament direction") of the fabric and the FR Yarns (such as those disclosed above) are interwoven in the direction opposite the cellulosic filament direction. In some embodiments, all of the yarns in the cellulosic filament direction comprise the non-FR cellulosic filament yarns. Alternatively, FR Yarns (such as, e.g., the FR Yarns having modacrylic fibers disclosed above) may be interspersed with the non-FR cellulosic filament yarns across the cellulosic filament direction randomly or in a pattern (e.g., cellulosic filament yarn, FR Yarn, FR Yarn, cellulosic filament yarn, FR Yarn, FR Yarn, etc.).

In other embodiments, the non-FR cellulosic filament yarns are provided in both the machine/warp and cross-machine/weft direction of the fabric. FR Yarns (such as those disclosed above) may be provided in the machine/warp direction, cross-machine/weft direction, or both machine/warp and cross-machine/weft directions and interspersed with the cellulosic filament yarns randomly or in a pattern.

The FR Yarns used throughout the fabric can be, but may not be, the same. For example, the FR Yarns interspersed with the cellulosic filament yarns in one direction may be the same or different from the FR Yarns provided in the opposite direction. By way only of example, in one embodiment FR Yarn having modacrylic fibers (e.g., FR Yarn #4) was provided in the cellulosic filament direction (along with the non-FR cellulosic filament yarns) while FR Yarn #6 was provided on every pick/end in the opposite direction.

The same flame resistance concerns may not arise when the fabric includes FR cellulosic filament yarns. However, other concerns, such as thermal shrinkage, may arise. In some embodiments, such as situations where the cellulosic filament yarns used in the fabric may suffer thermal shrinkage, it may be desirable but certainly not required to include Stabilizing Yarns in the fabric to prevent or minimize thermal shrinkage of the fabric. The Stabilizing Yarns must have sufficient resistance to thermal shrinkage. The Stabilizing Yarns can be spun, filament, or stretch broken yarns. Suitable materials and blends for the Stabilizing Yarns include, but are not limited to, those identified above for the FR Yarns. In most embodiments, the Stabilizing Yarns are FR but can include non-FR materials. In some embodiments, filament Stabilizing Yarns may be particularly suitable, including, but not limited to, filament Stabilizing Yarns comprising inherently FR materials, such as, but not limited to, aramid, PBI, PBO, and liquid crystal polymer material (e.g., VECTRAN™, available from Kuraray).

In some embodiments, non-Stabilizing Yarns (i.e., yarns that are not thermally stable and do not contribute to the thermal stability of the fabric) may be used in the fabric provided enough Stabilizing Yarns are provided to render the fabric thermally stable. Such non-Stabilizing Yarns can include any of the fibers or blends disclosed above for use in the FR Yarns.

In some embodiments, the cellulosic filament yarns are provided in only one of the machine/warp or cross-machine/weft direction (the "cellulosic filament direction") of the fabric and other yarns (e.g., Stabilizing Yarns and/or non-Stabilizing Yarns) are provided in the direction opposite the cellulosic filament direction. Alternatively, either or both of Stabilizing Yarns and non-Stabilizing Yarns may be interspersed with the cellulosic filament yarns across the cellulosic filament direction randomly or in a pattern. In may be desirable to provide Stabilizing Yarns at least in the cellulosic filament direction. For example, a fabric formed of 100% meta-aramid spun yarns (i.e., Stabilizing Yarns) in the warp direction and 100% FR rayon filament yarns in the weft direction (cellulosic filament direction) failed to pass the thermal shrinkage requirement in the weft direction, suggesting that Stabilizing Yarns may need to be included in the cellulosic filament direction to impart the necessary resistance to thermal shrinkage in that direction.

In other embodiments, the cellulosic filament yarns are provided in both the machine/warp and cross-machine/weft direction of the fabric. Stabilizing and/or non-Stabilizing Yarns may be provided in the machine/warp direction, cross-machine/weft direction, or both machine/warp and cross-machine/weft directions and interspersed with the cellulosic filament yarns randomly or in a pattern.

Any ratio of cellulosic filament yarns: FR Yarns or cellulosic filament yarns: Stabilizing Yarns may be used provided the fabrics pass the thermal protection requirements (char length and afterflame) as well as the thermal shrinkage requirements of NFPA 1971 and/or NFPA 2112. The yarn ratio may be calculated in two different ways—either by counting the individual yarns or by counting the ends. For example, when considering a plied yarn (e.g., a cellulosic filament yarn plied with a FR Yarn), each yarn can be considered individually for purposes of determining the ratio or the two plied yarns can be considered as a single end. For example, consider a fabric woven in a pattern with the following yarn repeat:

Two yarns, each formed by plying two FR Yarns; and

One yarn formed by plying a cellulosic filament yarn with one FR Yarn.

The ratio of cellulosic filament yarns: FR Yarns for such a fabric is 1:5 if each individual yarn is counted or 1:2 if each yarn end is counted.

Using either yarn ratio calculation method, the ratio of cellulosic filament yarns: FR Yarns (particularly those FR Yarns having modacrylic fibers) as well as cellulosic filament yarns: Stabilizing Yarns in the fabric can be from about 15:1 and any ratio under that all the way down to 1:1 (e.g., 10:1, or 9:1, or 8:1, or 7:1, or 6:1, or 5:1, or 4:1, or 3:1, or 2:1, or 1:1), including any non-integer increments in between (e.g., 13:2, 9:4, 3:2, etc.).

Any of the yarns contemplated herein may be combined, coupled, or covered (i.e., plied, ply twist, wrapped, coresheath, coverspun, etc.) with one or more other flame resistant or non-flame resistant spun yarns (or staple fibers), filament yarns, and stretch broken yarns made from any of the materials and/or blends discussed above for FR Yarns.

While cellulosic filament yarns are specifically discussed herein, other embodiments incorporate into the fabric other types of filament yarns, such as those comprising polyphenylene sulfide (PPS), polytetrafluoroethylene (PTFE), and liquid crystal polymer material (e.g., VECTRAN™, available from Kuraray).

In some embodiments, the fabrics disclosed herein have a weight between 2-8 ounces per square yard ("osy"), inclusive; 2-7 osy, inclusive; 2-5 osy, inclusive; and 2-4, inclusive. The fabric may be woven to have any desirable weave (e.g., plain, twill) or may be knitted (e.g., single, double, plain, interlock).

In some embodiments, the fabrics disclosed herein are quilted or otherwise attached (e.g., laminated) to other fabrics or membranes. By way only of example, in some embodiments the fabrics disclosed herein are facecloth fabrics that are quilted or otherwise attached to at least one insulating layer (such as a nonwoven batt) to form a thermal liner of a firefighter's garment. However, embodiments of the fabrics disclosed herein may be suitable for use in other applications.

In some embodiments, the fabric is not attached to other fabrics. By way only of example, in one embodiment the fabric is a knitted fabric having one side that is smooth (such as, but not limited to, having filament yarns exposed primarily on this side) and the opposite side that has been napped (so as to provide the desired insulation). Garments made with such a fabric may be formed such that the smooth side is located closest to the wearer for ease of donning, doffing, and wear.

The cellulosic filament yarns in embodiments of the woven or knitted fabrics help impart the desired slickness, soft hand, comfort, inherent wicking and easy dyeability and hydrophilic characteristics to the fabric. Moreover, these yarns are typically cheaper and easier to dye and print than aramid filament yarns typically used in facecloth fabrics.

The types and flame resistant properties of the cellulosic filament and optional other yarns in the fabric are preferably selected to ensure that the fabric (either alone or when attached to another layer, such as an insulating layer) complies with the thermal protective and thermal shrinkage requirements of NFPA 1971 and/or NFPA 2112.

Embodiments of the fabric disclosed herein were tested for compliance with the thermal protection requirements (char length and afterflame) as well as the thermal shrinkage requirements of NFPA 1971 and/or NFPA 2112. The inventive fabrics were tested alone as well as when attached to insulating layers. The following fabrics were tested:

1. Example #1 Composite Thermal Liner: 7.5 osy composite thermal liner formed of a dyed fabric according to an embodiment of the present invention (Inventive Fabric 1) attached to two insulating layers as follows:

Inventive Fabric 1:

3.6 osy woven fabric. The warp yarns consisted entirely of 26/1 cc 65% FR Rayon/25% Para-aramid/10% Nylon spun yarns. Two different yarns were provided in the fill direction—2 yarns of FR Rayon filament followed by 1 yarn of 200 denier Kevlar filament in a repeat pattern.

Insulating Layers:

1.5 oz Nomex/Kevlar spunlace 2.3 oz Nomex/Kevlar spunlace

2. Example #2 Composite Thermal Liner: 7.6 osy composite thermal liner formed of a dyed fabric according to an embodiment of the present invention (Inventive Fabric 2) attached to two insulating layers as follows:

Inventive Fabric 2:

3.7 osy woven fabric. The warp yarns consisted entirely of 26/1 cc 65% FR Rayon/25% Para-aramid/10% Nylon spun yarns. Two different yarns were provided in the fill direction—4 yarns of FR Rayon filament followed by 1 yarn of 200 denier Kevlar filament in a repeat pattern.

Insulating Layers:

1.5 oz Nomex/Kevlar spunlace 2.3 oz Nomex/Kevlar spunlace

3. Example #3 Composite Thermal Liner: 7.5 osy composite thermal liner formed of a dyed fabric according to an embodiment of the present invention (Inventive Fabric 3) attached to two insulating layers as follows:

Inventive Fabric 3:

4.2 osy woven fabric. The warp yarns consisted entirely of 26/1 cc 65% FR Rayon/25% Para-aramid/10% Nylon spun yarns. Two different yarns were provided in the fill direction—9 yarns of FR Rayon filament followed by 1 yarn of 200 denier Kevlar filament in a repeat pattern.

Insulating Layers:

1.5 oz Nomex/Kevlar spunlace 2.3 oz Nomex/Kevlar spunlace

Table A below sets forth the results of testing the Inventive Fabrics in isolation.

TABLE A

| | Inventive Fabric 1 | Inventive Fabric 2 | Inventive Fabric 3 | NFPA 1971 Requirement |
|---|---|---|---|---|
| Vertical Flammability (Initial) (ASTM 6413) | | | | |
| Char Length (inch) | 1.0 × 1.2 | 1.0 × 1.3 | 1.6 × 2.2 | ≤4 |
| After Flame (sec) | 0 | 0 | 0 | ≤2 |
| Vertical Flammability (5x after wash) (ASTM 6413) | | | | |
| Char Length (inch) | 0.9 × 1.2 | 1.0 × 2.2 | 3.0 × 3.0 | ≤4 |
| After Flame (sec) | 0 | 0 | 1.7 × 2.0 | ≤2 |
| Thermal Shrinkage (%) (ISO 17493) | | | | |
| Before Wash | 5.9 × 5.6 | 5.1 × 9.5 | 9.5 × 14.6 | ≤10 |
| After Wash, 5x | 7.0 × 6.6 | 7.7 × 9.8 | 8.8 × 13.3 | ≤10 |

Table B sets forth the results of testing the Example Composite Thermal Liners formed by the Inventive fabrics attached to the insulating layers.

TABLE B

| | Example #1 Composite Thermal Liner | Example #2 Composite Thermal Liner | Example #3 Composite Thermal Liner | NFPA 1971 Requirement |
|---|---|---|---|---|
| Vertical Flammability (Initial) (ASTM 6413) | | | | |
| Char Length (inch) | 0.4 × 0.4 | 0.5 × 0.4 | 0.6 × 0.5 | ≤4 |
| After Flame (sec) | 0 | 0 | 0 | ≤2 |
| Vertical Flammability (5x after wash) (ASTM 6413) | | | | |
| Char Length (inch) | 0.4 × 0.3 | 0.3 × 0.5 | 0.3 × 0.2 | ≤4 |
| After Flame (sec) | 0 | 0 | 0 | ≤2 |
| Thermal Shrinkage (%) (ISO 17493) | | | | |
| Before Wash | 2.8 × 4.8 | 2.6 × 6.7 | 4.6 × 9.1 | ≤10 |
| After Wash, 5x | 2.8 × 5.4 | 2.7 × 7.7 | 3.8 × 8.8 | ≤10 |

Different arrangements of the components described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

The invention claimed is:

1. A flame resistant fabric comprising first yarns and second yarns, wherein:

(i) the first yarns consist of filament yarns consisting of non-flame resistant cellulosic material;

(ii) the second yarn comprise flame resistant spun yarns comprising FR modacrylic fibers; and (iii) the fabric has a machine and cross-machine direction and a thermal shrinkage of 10% or less in both the machine and cross-machine directions when tested in accordance with ISO 17493 (2000).

2. The flame resistant fabric of claim 1, wherein the non-flame resistant cellulosic material comprises rayon or lyocell.

3. The flame resistant fabric of claim 1, wherein at least some of the flame resistant spun yarns comprise 30-90% FR modacrylic fibers.

4. The flame resistant fabric of claim 1, wherein at least some of the flame resistant spun yarns further comprise at least one of cellulosic fibers or inherently flame resistant fibers other than FR modacrylic fibers.

5. The flame resistant fabric of claim 4, wherein the at least some of the flame resistant spun yarns comprise approximately 40-70% FR modacrylic fibers, approximately 30-40% cellulosic fibers, and approximately 10-15% aramid fibers.

6. A flame resistant fabric comprising first yarns having a first yarn material composition and second yarns having a second yarn material composition different from the first yarn material composition, wherein:

(i) the first yarns consist of filament yarns consisting of the first yarn material composition, wherein the first yarn material composition consists of flame resistant cellulosic material;

(ii) the second yarns comprise filament yarns, spun yarns, or stretch broken yarns;

(iii) the fabric has a machine direction and a cross-machine direction and the first yarns and the second yarns are both provided in at least one of the machine direction or the cross-machine direction of the fabric; and (iv) the fabric has a thermal shrinkage of 10% or less in both the machine and cross-machine directions when tested in accordance with ISO 17493 (2000).

7. The flame resistant fabric of claim 6, wherein the flame resistant cellulosic material comprises flame resistant rayon or flame resistant lyocell.

8. The flame resistant fabric of claim 6, wherein the second yarns comprise filament yarns.

9. The flame resistant fabric of claim 6, wherein the second yarns comprise inherently flame resistant materials.

10. The flame resistant fabric of claim 9, wherein the inherently flame resistant materials comprise para-aramid, meta-aramid, PBI, PBO, or liquid crystal polymer material.

11. The flame resistant fabric of claim 6, wherein the fabric further comprises third yarns having a third yarn material composition different from the first yarn material composition and the second yarn material composition.

12. The flame resistant fabric of claim 6, wherein the second yarns comprise spun yarns.

13. The flame resistant fabric of claim 6, wherein the fabric comprises at least one second yarn for every fifteen first yarns in the at least one of the machine direction or the cross-machine direction of the fabric.

14. The flame resistant fabric of claim 6, wherein:

the second yarns comprise inherently flame resistant materials;

the fabric further comprises flame resistant third yarns having a third yarn material composition different from the first yarn material composition and the second yarn material composition;

the first yarns and the second yarns are both provided in one of the machine direction or the cross-machine direction of the fabric; and the third yarns are provided in the other of the machine direction or the cross-machine direction of the fabric.

15. A flame resistant composite fabric comprising a first fabric attached to a second fabric, wherein the first fabric comprises first yarns having a first yarn material composition and second yarns having a second yarn material composition different from the first yarn material composition, wherein:

(i) the first yarns consist of filament yarns consisting of the first yarn material composition, wherein the first yarn material composition consists of flame resistant cellulosic material;

(ii) the second yarns comprise filament yarns, spun yarns, or stretch broken yarns;

(iii) the first fabric has a machine direction and a cross-machine direction and the first yarns and the second yarns are both provided in at least one of the machine direction or the cross-machine direction of the first fabric; and (iv) the composite fabric has a thermal shrinkage of 10% or less when tested in accordance with ISO 17493 (2000).

16. The flame resistant composite fabric of claim 15, wherein the composite fabric is a thermal liner having a char length of less than or equal to four inches and an afterflame of less than or equal to two seconds when tested in accordance with ASTM D6413 (1999).

17. The flame resistant composite fabric of claim 15, wherein the composite fabric further comprises a third fabric to which the first and second fabrics are attached.

18. The flame resistant composite fabric of claim 15, wherein the flame resistant cellulosic material comprises rayon or lyocell.

19. The flame resistant composite fabric of claim 15, wherein the second yarns comprise inherently flame resistant materials.

20. The flame resistant composite fabric of claim 15, wherein the first fabric further comprises third yarns having a third yarn material composition different from the first yarn material composition and the second yarn material composition.

21. The flame resistant composite fabric of claim 20, wherein:

the first yarns and the second yarns are both provided in one of a machine direction or a cross-machine direction of the first fabric;

at least one second yarn is provided in the one of the machine direction or the cross-machine direction for every fifteen first yarns in the one of the machine direction or the cross-machine direction; and the third yarns are provided in the other of the machine direction or the cross-machine direction of the first fabric.

22. The flame resistant composite fabric of claim 21, wherein at least one of the second yarns or the third yarns comprise inherently flame resistant fibers.

23. The flame resistant fabric of claim 1, wherein the fabric has a char length of less than or equal to four inches and an afterflame of less than or equal to two seconds when tested in accordance with ASTM D6413 (1999).

24. The flame resistant fabric of claim 6, wherein the fabric has a char length of less than or equal to four inches and an afterflame of less than or equal to two seconds when tested in accordance with ASTM D6413 (1999).

25. The flame resistant fabric of claim 11, wherein the second yarns and the third yarns each comprise spun yarns comprising inherently flame resistant fibers.

26. The flame resistant fabric of claim 14, wherein:

the first yarns and the second yarns are both provided only in the one of the machine direction or the cross-machine direction of the fabric; and the third yarns are only provided in the other of the machine direction or the cross-machine direction of the fabric.

27. A flame resistant composite fabric comprising a first fabric attached to a second fabric, wherein the first fabric comprises first yarns and second yarns and wherein:

(i) the first yarns consist of filament yarns consisting of non-flame resistant cellulosic material;

(ii) the second yarns comprise flame resistant spun yarns comprising FR modacrylic fibers; and (iii) the composite fabric has a thermal shrinkage of 10% or less when tested in accordance with ISO 17493 (2000).

28. The flame resistant composite fabric of claim 27, wherein the composite fabric is a thermal liner having a char length of less than or equal to four inches and an afterflame of less than or equal to two seconds when tested in accordance with ASTM D6413 (1999).

29. The flame resistant composite fabric of claim 27, wherein the composite fabric further comprises a third fabric to which the first and second fabrics are attached.

30. The flame resistant fabric of claim 27, wherein at least some of the flame resistant spun yarns further comprise at least one of cellulosic fibers or inherently flame resistant fibers other than FR modacrylic fibers.

31. The flame resistant fabric of claim 30, wherein the at least some of the flame resistant spun yarns comprise approximately 40-70% FR modacrylic fibers, approximately 30-40% cellulosic fibers, and approximately 10-15% aramid fibers.

* * * * *